United States Patent [19]

Reichert

[11] 3,941,037

[45] Mar. 2, 1976

[54] CASE FORMING AND TRANSFERRING MACHINE

[75] Inventor: Donald G. Reichert, Tarpon Springs, Fla.

[73] Assignee: A B C Packaging Machine Corporation, Tarpon Springs, Fla.

[22] Filed: Oct. 7, 1974

[21] Appl. No.: 512,980

[52] U.S. Cl. ..... 93/51 R; 53/159; 53/183; 53/252; 93/59 ES

[51] Int. Cl.[2] ..... B31B 1/44; B65B 47/00

[58] Field of Search ..... 53/26, 29, 159, 164, 183, 53/186, 207, 249, 266, 252; 93/51 R, 53 SD, 53 FB, 51 H, 51 W, 51 M, 59 CE, 59 ES, 59 MT, 59 PL

[56] References Cited

UNITED STATES PATENTS

| | | | |
|---|---|---|---|
| 1,037,372 | 9/1912 | Upton et al. | 93/59 ES |
| 2,997,830 | 8/1961 | Nelson | 53/164 X |
| 3,004,478 | 10/1961 | Phin | 93/59 ES |
| 3,022,615 | 2/1962 | Schroeder et al. | 53/183 X |
| 3,318,205 | 5/1967 | Lefief | 93/51 R |
| 3,478,487 | 11/1969 | Smith et al. | 53/186 X |
| 3,509,688 | 5/1970 | Hartbauer et al. | 53/164 X |
| 3,611,885 | 10/1971 | Paxton | 93/59 ES |
| 3,659,505 | 5/1972 | Wasyluka et al. | 93/59 PL |
| 3,748,797 | 7/1973 | Deines | 53/152 X |
| 3,783,752 | 1/1974 | Langen et al. | 93/53 SD |
| 3,858,489 | 1/1975 | Paxton | 93/51 R |

*Primary Examiner*—Robert L. Spruill
*Attorney, Agent, or Firm*—Newton, Hopkins & Ormsby

[57] ABSTRACT

A packaging process and machine for performing the process is disclosed by which flat case blanks are stripped from a stack of blanks at a case storage and stripping station and then formed into open cases at a case forming station. The open cases are then transferred from the case forming station to a product stacking and packing station where products are grouped into layers, the layers stacked one upon the other, and the stack packed into the open case. The packed cases are then moved to a case sealing station and there sealed.

9 Claims, 9 Drawing Figures

16
22
501
502
504
506
508
510
511
513
515
518
520
521
524
525
527
529
530
531
540
541
542
543
545
548
549
550
553
555
558
559
560
561
563
564
566
569
570
571
572
574
575
580
582
584
586
587
590
595
596
597

CASE FORMING AND TRANSFERRING MACHINE

BACKGROUND OF THE INVENTION

This invention relates generally to packaging processes and machines, and particularly to processes and machines for packaging stacks of multi-layered groups of products in cases.

It is a general object of the invention to provide an improved process and machine for packaging multi-layered groups of products.

More specifically, it is an object of the invention to provide a packaging process by which cases may be formed from case blanks, products grouped and stacked, the formed cases packed with the stacks of products, and the packed cases sealed all by one continuous and repetitive series of process steps.

Another object of the invention is to provide a packaging process of the type just described which may be conducted in an efficient, expeditious and reliable manner.

Another object of the invention is to provide a packaging machine in which products may be sequentially fed, grouped together into distinct layers, arranged into multi-layered stacks and packed into a case.

Another object of the invention is to just provide a packaging machine of the type just described in which case blanks may be formed into open cases, packed with goods and sealed.

Yet another object of the invention is to provide a packaging machine of the type just described which may operate in an efficient, expeditious and reliable manner.

SUMMARY OF THE INVENTION

In one form of the invention a packaging process is provided by which flat case blanks are stripped from a stack of blanks at a case storage and stripping station, formed into open cases at a case forming station, and transferred to a product stacking and packing station. Products are grouped at the product stacking and packing station into layers which are then stacked one upon the other to form stacks of products. The stacks of products are then packed in the open cases which thereafter are moved to a case sealing station and there sealed.

In another form of the invention a packaging machine is provided comprising means for stripping flat case blanks from a stack of blanks at a case storage and stripping station, means for forming the stripped flat case blanks into open cases, at a case forming station and means for transferring the formed open cases from the case forming station to a product stacking and packing station. The machine further comprises means for grouping products at the product stacking and packing station into layers and for stacking the layers one upon the other to form stacks of products, means for packing the stacks of products into the open cases, and means for moving the packed cases to a case sealing station and there sealing the cases.

DETAILED DESCRIPTION OF THE DRAWING

I. GENERAL DESCRIPTION

Figure 1:
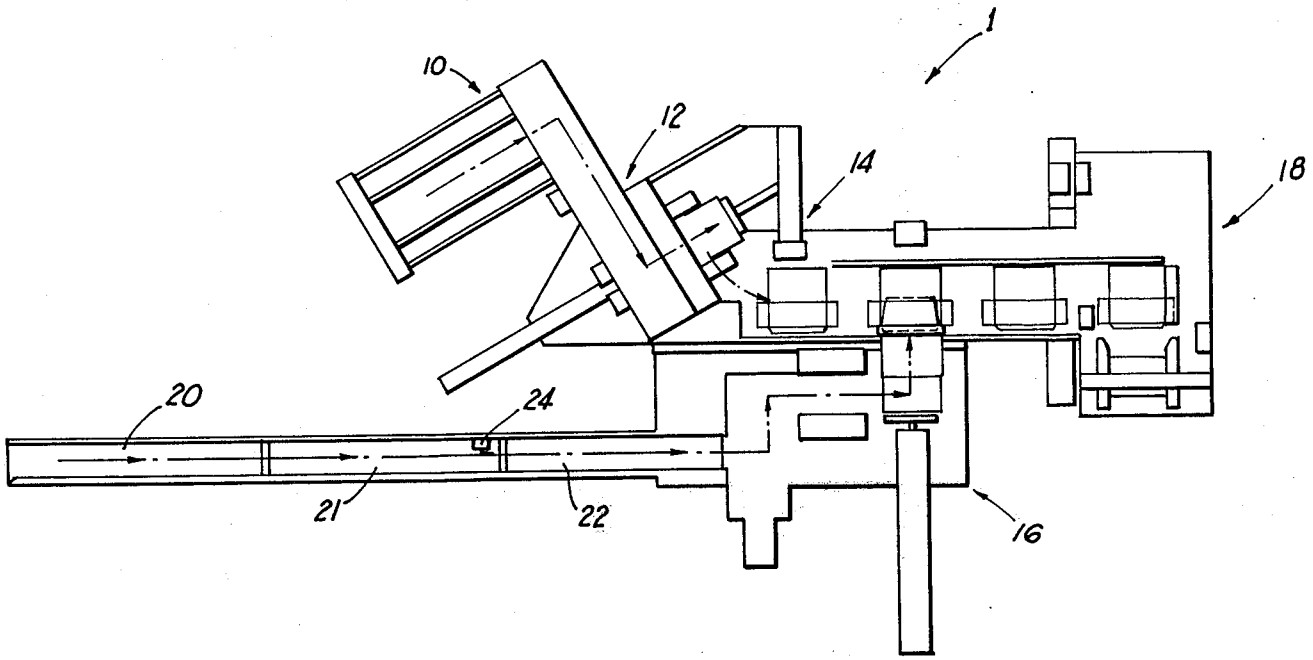
FIG. 1 is a schematic plan view of a packaging machine embodying principles of the invention in preferred forms, which machine may be employed in performing packaging processes conducted in accordance with other principles of the invention.

Referring now in more detail to the drawing, there is schematically illustrated in FIG. 1 a packaging machine 1 providing a case storage and stripping station 10 in which case blanks are removed one at a time from a stack of blanks, a case forming station 12 where case blanks are opened and their bottoms sealed, and a case transferring station 14. The machine also includes a product stacking and packing station 16 and a case sealing station 18. The product stacking and packing station is seen to include a limit valve 24 plus a series of three conveyor belts 20, 21 and 22 driven at mutually diverse velocities in order to group products for packing as hereinfafter explained.

Figure 2:
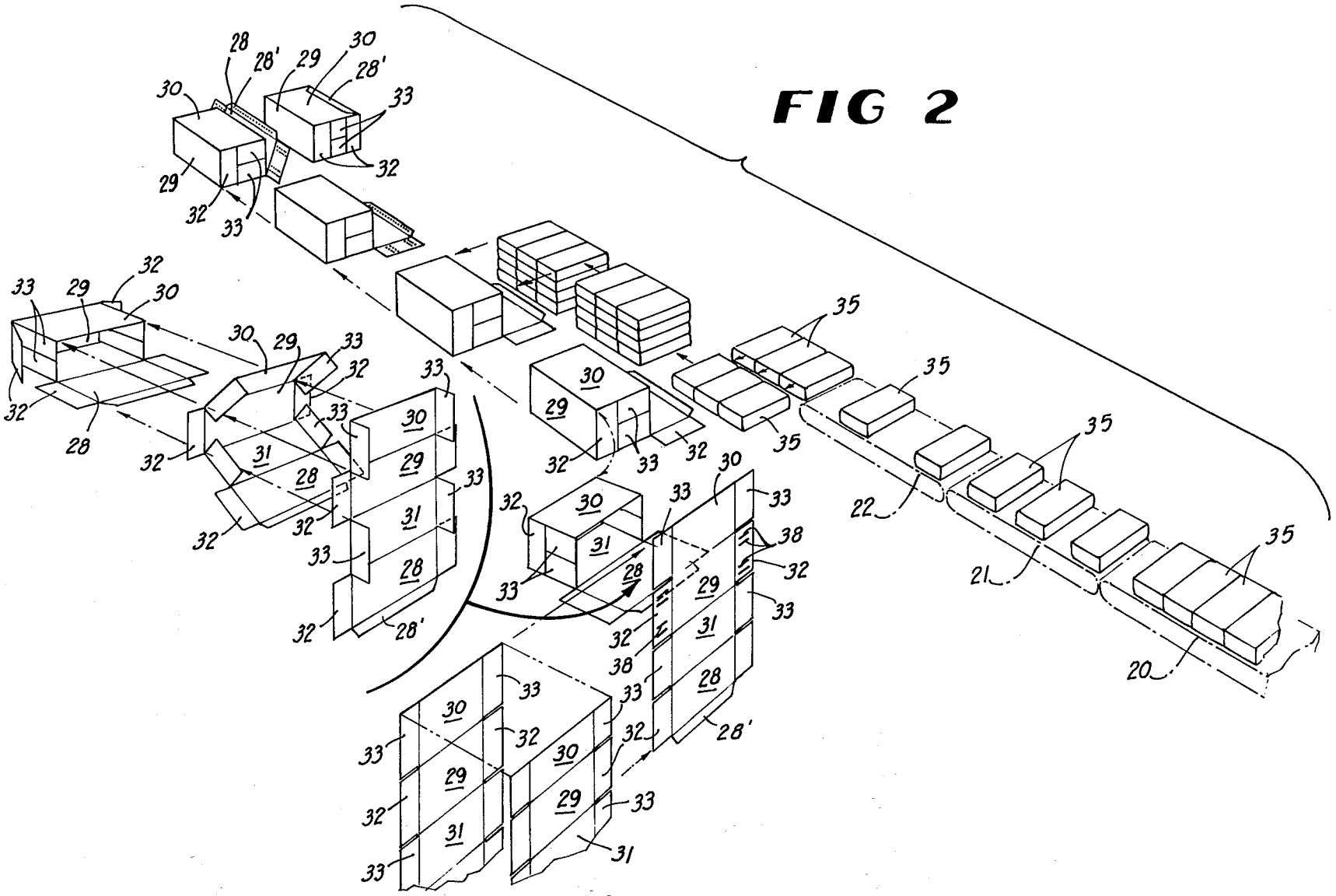
FIG. 2 is a schematic view in perspective of goods and container cases therefor undergoing a series of packaging process steps performable by the machine of FIG. 1.

The principle packaging process steps performed by the just described machine on cases and products is schematically illustrated in FIG. 2. Here, cardboard case blanks 25 are seen to be composed of a set of planar panels unitarily hinged together to provide a case top panel 28 and a top tab 28', a bottom panel 29, a front panel 30, a rear panel 31, four end flaps 32 and four end sides 33. The case blanks are first striped from a position at the end of a stack of vertically juxtaposed blanks to a position closely adjacent the stack end at the case storage and stripping station 10. From here each individually stripped blank is moved laterally from the stack to the case forming station 12 where strips of adhesive 38 are coated on the pair of end flaps 32 hinged to bottom panel 29. Here, the front and rear panels 30 and 31 are folded into a parallel relation, the four end sides 33 folded, and the end flaps 32 hinged to the bottom panel folded over portions of the end sides and secured thereto by the adhesive. With all walls of the case now formed except for that provided by the top panel the case is moved at a case transferring station 14 into position for receipt of goods at the product stacking and packing station 16.

At the product stacking and packing station individual goods or packs of goods 35 are placed upon conveyor belt 20 which is driven continuously at a relatively slow velocity. To insure spacial separation between the individual packs the goods are delivered by belt 20 onto a second conveyor belt 21 which is driven at a higher velocity than belt 20. This belt is also driven continuously until such time as limit valve 24 should sense the continued presence of a pack for a selected period of time in which event belt 21 is halted. From conveyor belt 21 the packs of goods are delivered to the third belt 22 which is independently driven at a faster speed than belt 21 which further increases the spacings between the individual packs. Conveyor belt 22 is driven whenever less than a predetermined number of packs, such as the illustrated group of three, are present at a receiving dock adjacent the end of the belt. At all other times the belt is halted. From the receiving dock individual groups of packs are stacked verticially by elevator means and then inserted into the awaiting case. Finally, the packed cases are moved to the case sealing station 18 where the case top panel 28 is folded and the top tab 28 and two other end flaps 32 coated with adhesive and sealed to front panel 30 and to end sides 33, respectively.

II. CASE STORAGE AND STRIPPING STATION

Figure 3:
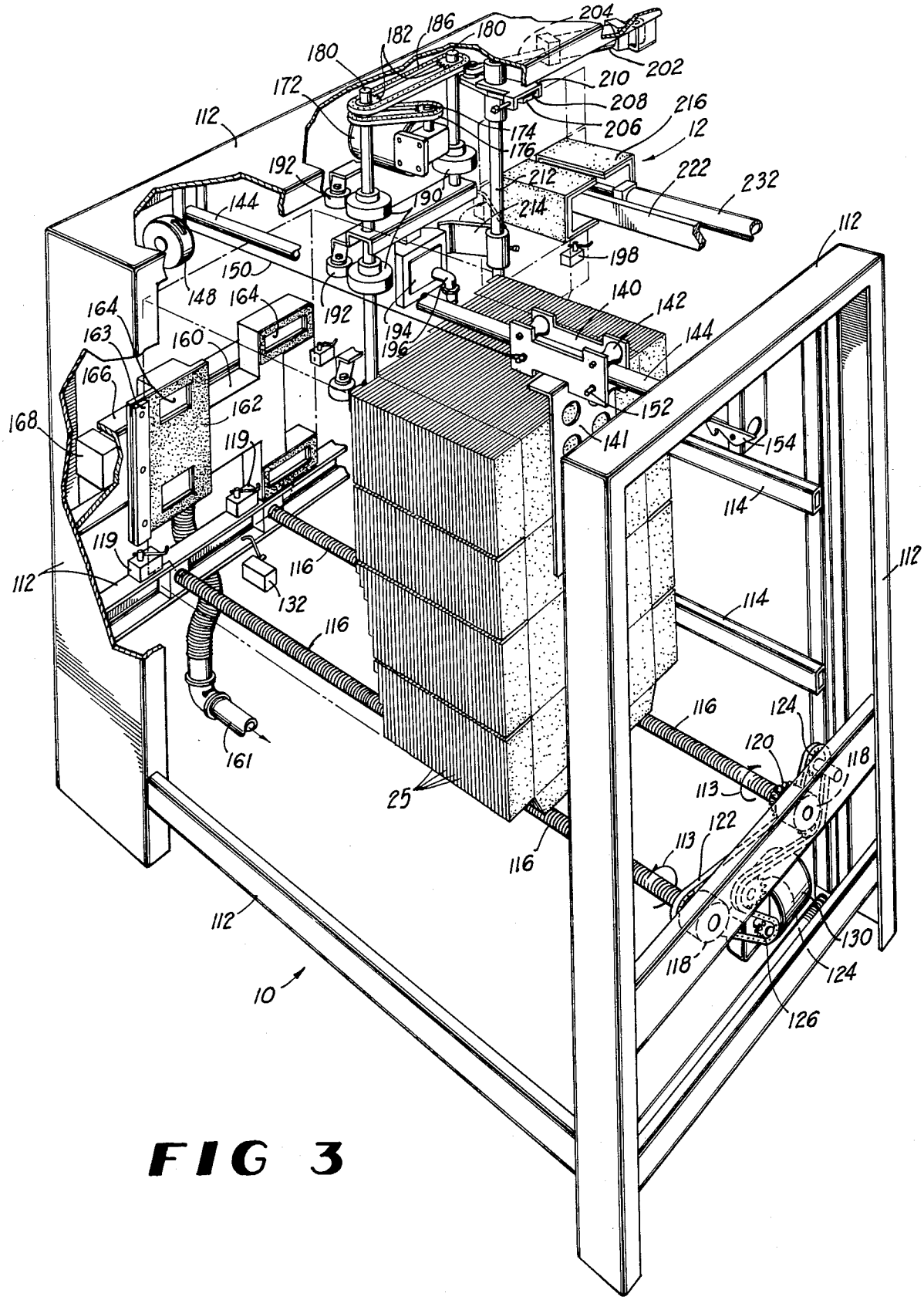
FIG. 3 is a perspective view of the case storage and stripping station of the packaging machine shown in Figure 1.

With reference next to FIG. 3, the case storage and stripping station 10 of the packaging machine 1 is seen to include a pair of parallel feed screws or augers 116 supported upon a frame 112 and adapted to be driven in the opposite rotary directions indicated by arrows 113. This drive is accomplished by means of a gear head motor 130 having a motor drive sprocket 126 in mesh with a drive chain 122 that is routed over a pair of idler sprockets 124 and into mesh with sprockets 120 of air clutches 118. Two pairs of guide rails 114 extend above the feed screws to the other side of frame 112 where a pair of limit valves 119 are located which serve to control operation of the feed screws through control of the air clutches. Another limit valve 132 is provided here to sense a depleted condition of the case blanks stored vertically upon the screws.

In addition to the positive, intermittent drive provided by feed screws to the bottom of the case blanks their upper portion is also biased to the left, as viewed in this FIG. 3, by means of a pressure plate 141 suspended from a dolly 140 moveably mounted to a dolly guide rail 144 by means of dolly rollers 142. The dolly is provided with a latching lug 152 by which the pressure plate may be held to the right by cooperating latch 154 during blank replenishments. When not so latched the dolly and pressure plate are biased to the left by means of a recoil reel 148 from which a cable 150 extends to the dolly.

For individually stripping end case members from the stack a vertically oriented stripping blade 163 is mounted to one edge of a Teflon stripping plate 162 having a set of suction apertures 164 formed therein which communicate through a manifold to an unshown vacuum pump. The stripping plate and suction manifold assembly is mounted to a hydraulic cylinder 168 in sliding engagement with a slide bar 166 rigidly secured to frame 112. Pairs of aligned case feed rollers 190 are secured to a pair of feed roller drive shafts 180 which are coupled with a gear head motor 172 by means of a drive chain 176 in mesh with a motor drive sprocket 174 and a coupling chain 186 in mesh with coupling sprockets 182. A backing roller 192 is spring biased into rotatable engagement with each case feeding roller 190. Finally, a pair of tucking fingers 214 (only one of which is shown in FIG. 3) are provided for urging the case blanks completely out of the feed and backing rollers with each tucking finger being secured to a drive shaft 212. This drive shaft is rotatably driven by a cylinder 202 having a cylinder piston rod 204 pivoted to a lever 206 mounted to the drive shaft. A limit spring 208 is provided to inhibit excess force from being applied to a case blank by the tucking fingers.

III. CASE FORMING STATION

Figure 4:
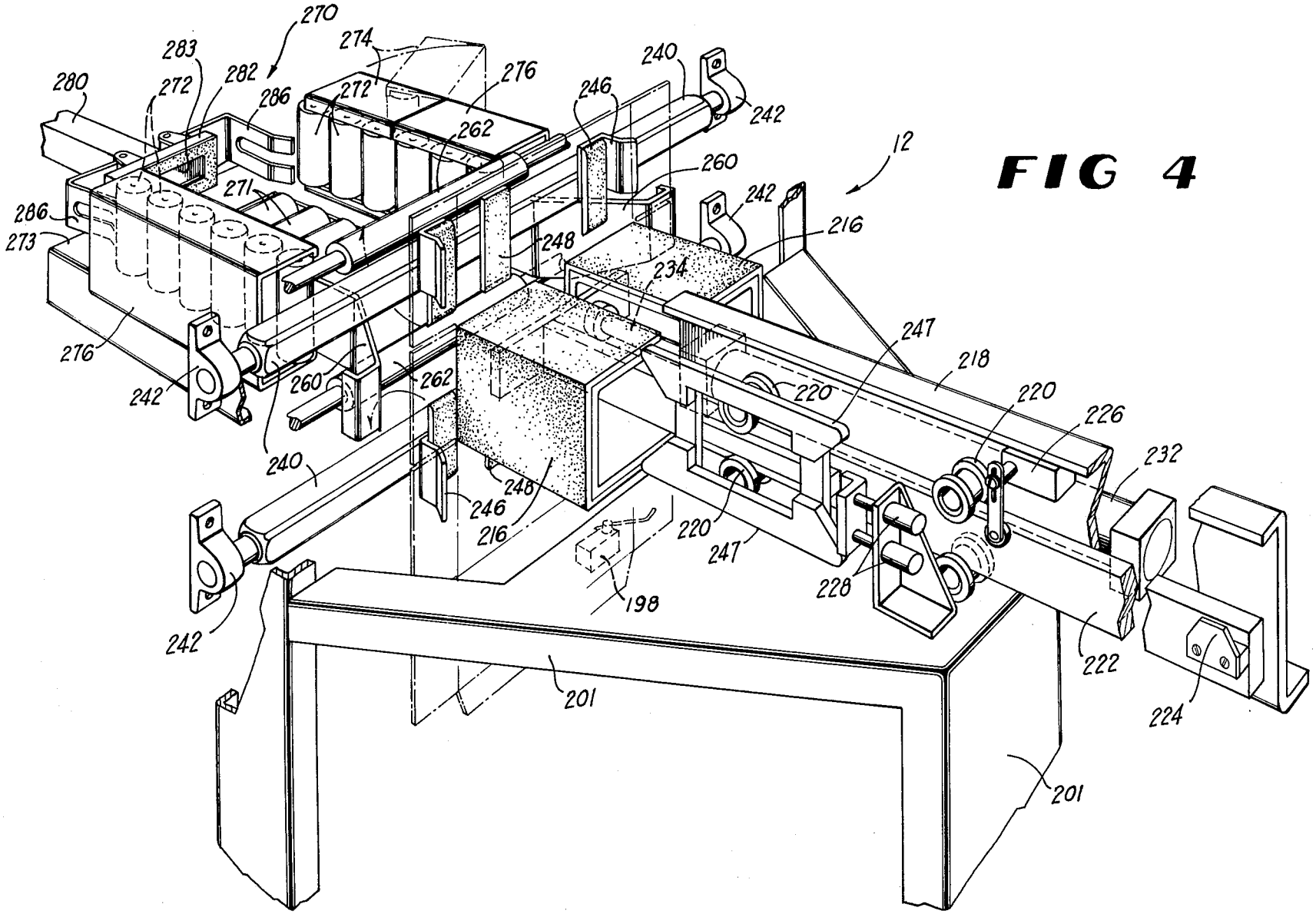
FIG. 4 is a perspective view of the case forming station of the machine shown in FIG. 1.

The case forming station is seen in FIG. 4 to include a frame 201 above which is rigidly mounted a case forming head support frame 218. A case forming head or mandrel 216 is mounted to the end of a slide bar 222 that is slidably disposed between a set of rollers 220 rotatably mounted to the support frame. A pair of stay bars 247 are secured to one side of the slide bar. An hydraulic cylinder 232 is secured atop frame 201 aside frame 218 with its piston rod 234 mounted to a case forming head 216. A limit valve 226 is mounted to frame 218 to sense the position of the forming head 216 through contact with a limit valve actuating cam 224 mounted to the end of slide bar 222.

With continued reference to FIG. 4 the case forming station is seen further to include a case receiving chamber 270 partially bounded by a bed of fixed rollers 271 mounted to a case compression platform 273 for rotation about parallel horizontal axes, and two parallel sets of rollers 272 mounted for rotation about vertical axes to each side of the bed of fixed rollers. All of the vertical rollers to the left of the bed, as viewed in this figure, are journalled in a fixed roller compartment 276 while half of the rollers to the right side of the bed are journalled in another fixed roller compartment 276 with the remaining half being rotatably mounted in a pivotable roller compartment 274. At the end of the bed is located a case gripping and indexing mechanism comprising a suction plate 282 having a suction aperture 238 mounted to an indexing arm 280 in which a suction manifold is located in fluid communication with aperture 283. A pair of case gripping fingers 286 are hinged to the indexing arm behind the suction plate. The gripping fingers are spring biased inwardly towards one another by the tension springs 287 shown in Figure 5.

Aside the entrance of the case receiving chamber are mounted four journals 242 in which two cam bars 240 are pivotally disposed one above the other. To a central portion of each cam bar is rigidly secured a hold down plate 248 straddled by another pair of L-shaped folding fingers 246. A fixed pair of folding cams 260 are also rididly mounted aside the case receiving chamber entrance between a pair of pressure rollers 262 spring biased towards one another. A pair of stay bars 247 are secured to one side of slide bar 222 for engagement with the hold down plates 248 mounted to pivotable cam bar 240. A shock absorber is also mounted atop the frame 201.

IV. CASE TRANSFERRING STATION

Figure 5:
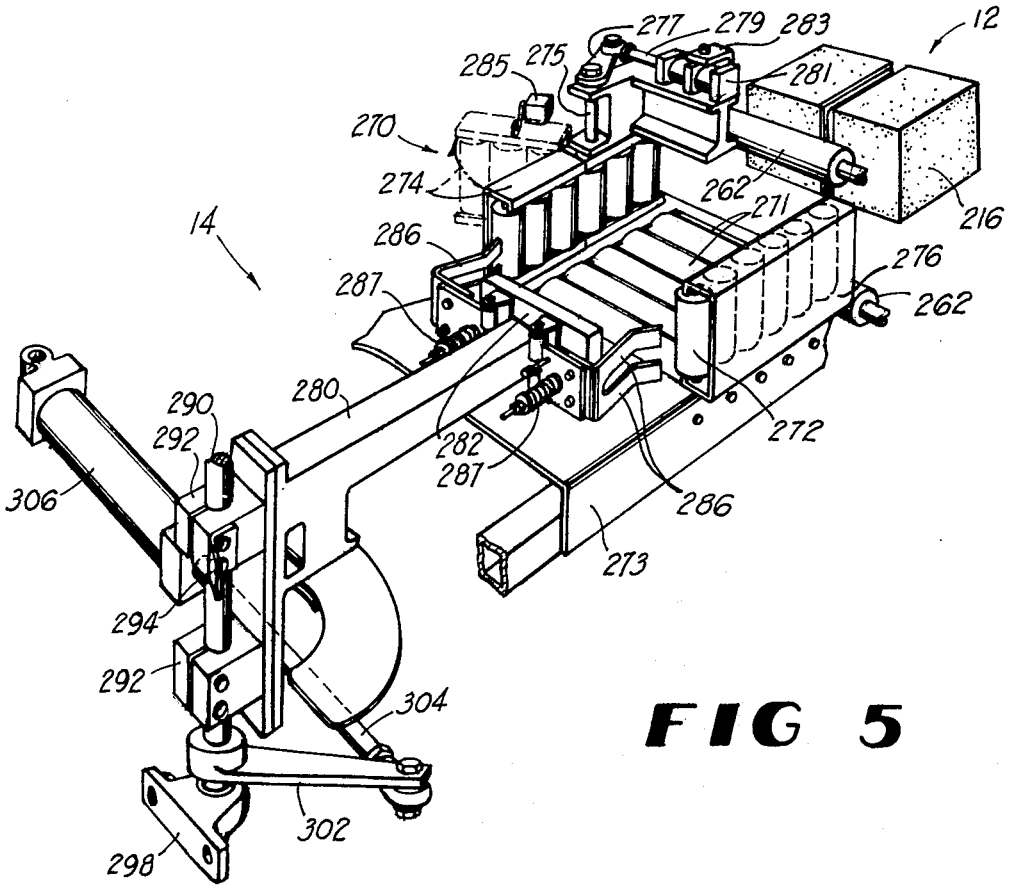
FIG. 5 is another view of the case forming station shown from a different perspective from that of FIG. 4 together with a case transferring station of the machine with case transferring apparatus therein shown in a case receiving position.
Figure 6:
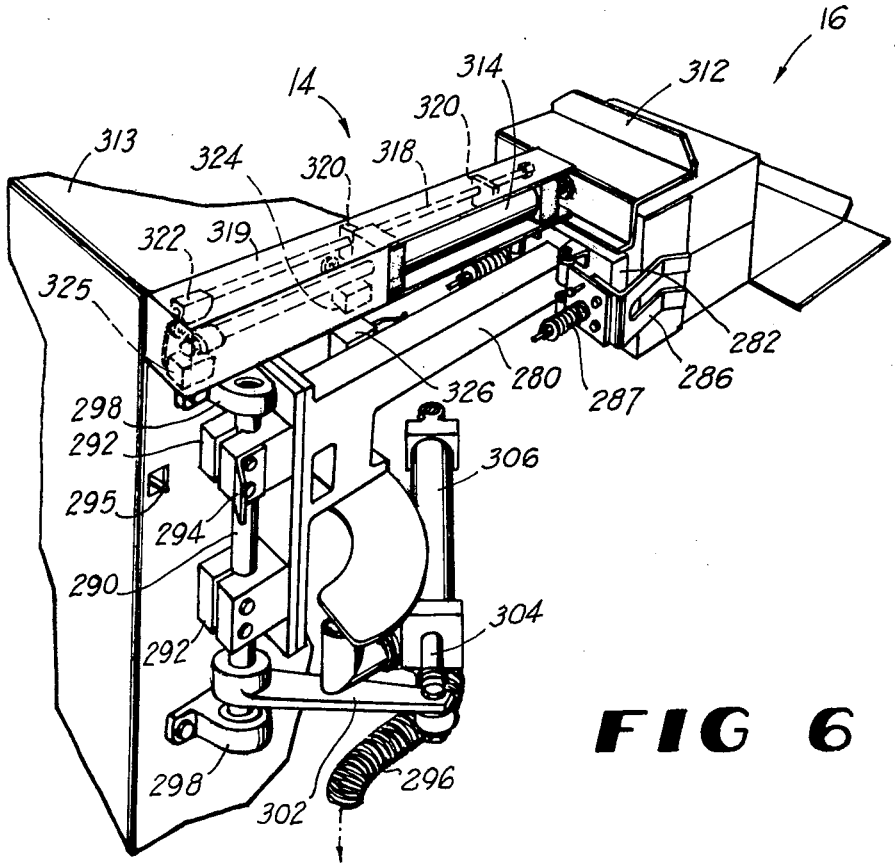
FIG. 6 is another perspective view of the case transferring station shown in FIG. 5 with the case transferring apparatus shown in case delivering postion.

With references next to FIGS. 5 and 6, the case transferring station is seen to include the indexing arm 280 having the just described case gripping mechanism secured to one end thereof. In FIG. 5 the indexing arm is shown in position to retrieve a case from the case receiving chamber 270 while in FIG. 6 the arm is shown pivoted some 90° to deliver the case to the product stacking and packing station 16. Pivoting of the indexing arm is accomplished by means of an hydraulic cylinder 306 having a piston rod 304 coupled to a crank arm 302 which is rigidly secured to a shaft 290 journalled in bearing mount 298. The indexing arm is also rigidly secured to shaft 290 by means of two split mounting blocks 292 with the upper block having a limit valve actuating tab 294 secured thereto. A flexible suction hose 296 extends from the bottom of the indexing arm to an unshown suction pump.

In order for the indexing arm to pivot counterclockwise from its position shown in FIG. 5 without jamming a case against the compression rollers bounding chamber 270 a mechanism is provided for pivoting roller compartment 274. This mechanism includes an hydraulic cylinder 281 secured to a pivotable mounting bracket 283 with its piston rod 279 coupled with a crank 277 rigidly mounted atop a drive shaft 275 secured to the pivotable roller compartment. A limit valve 285 is mounted atop this compartment to sense its position.

In FIG. 6 means are shown for urging a gripped case out of the indexing arm gripping means and into the product stacking and packing station. This means comprises an hydraulic cylinder 314 mounted within a cylinder housing 319 rigidly secured to a frame member 313. To one end of the cylinder piston rod is mounted a case push off plate 312 while the other end of the piston rod extends out of the opposite end of the cylinder within housing 319 for movement into and out of tripping engagement with a pair of limit valves 324 and 325. A guide rod 318 is also disposed within housing 319 journalled through a pair of collars 320 with a lug 322 mounted to the end of the rod distal the push off plate. Finally, a limit valve 295 is mounted to frame 313 in alignment with actuating tab 294.

V. PRODUCT STACKING AND INSERTING STATION

Figures 7, 8:
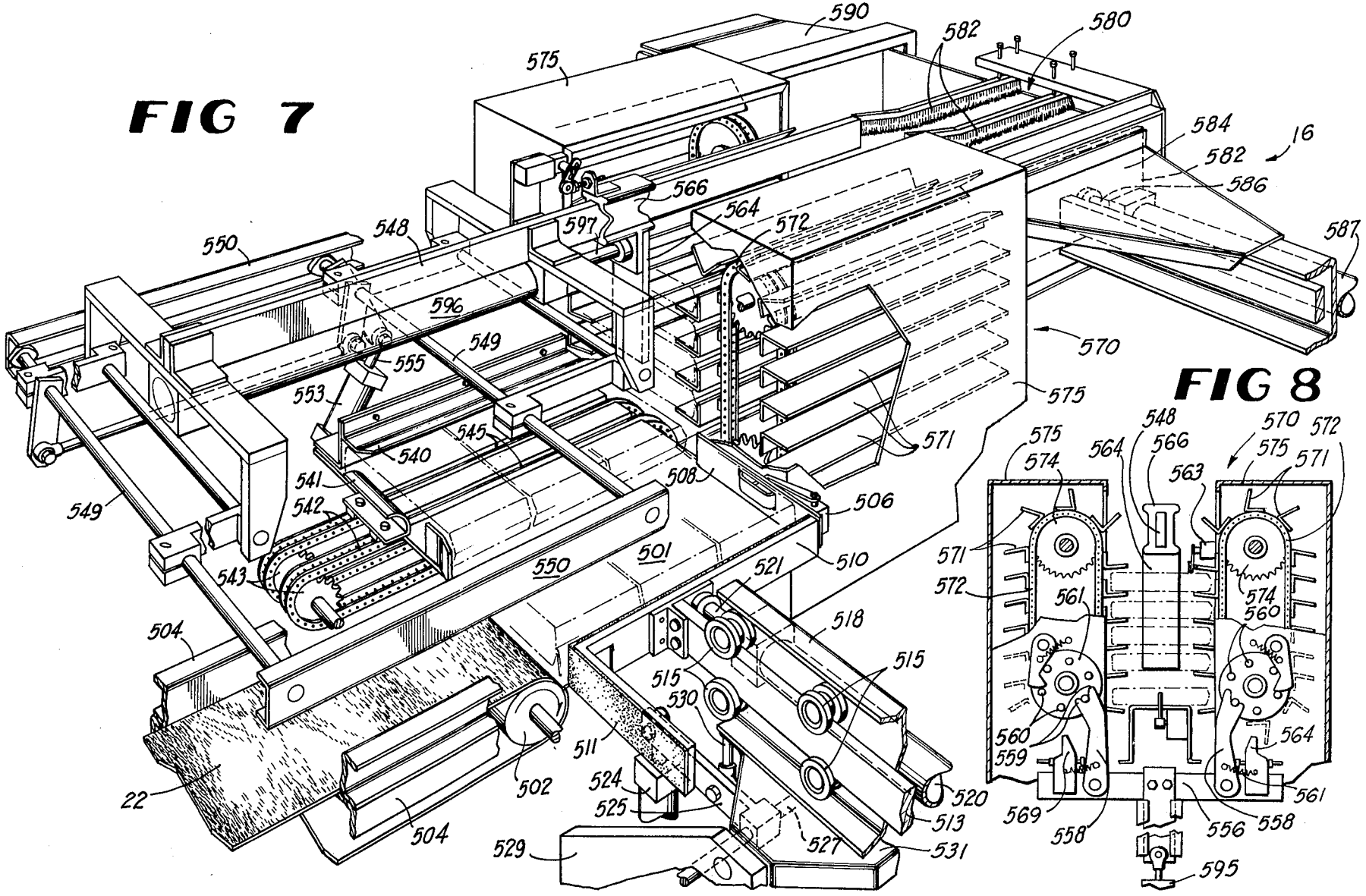
FIG. 7 is a perspective view of the product stacking and packing station of the machine shown in FIG. 1.
FIG. 8 is an end on view in elevation of the elevator component of the product stacking and packing station shown in FIG. 7.

Referring next to FIG. 7 and 8, the packaging machine product stacking and packing station is seen to include a case receiving dock 501 at the end of conveyor belt 22 adjacent a belt drive roller 502 rotatably journalled to product guide rails 504. A limit valve 506 is mounted to a stop plate 508 at the end of the dock to detect a fully loaded dock condition. A push plate 510 is shown movably disposed and aside dock 501 from one side of which plate a product stop plate 511 extends. The push and stop plate assembly is mounted to the end of a slide bar 513 slidably mounted between four rollers 515 journalled to a pivotable slide bar frame 518. An hydraulic cylinder 520 is mounted to frame 518 with the end of its piston rod 521 rigidly mounted to stop plate 510. Another hydraulic cylinder 524 is provided having its piston rod pivoted to one end of an arm 525 which has its opposite end mounted to a shaft 527 journalled to a fixed frame member 529. To the middle arm 525 is mounted an extension rod 530 which is coupled to the bottom of the pivotable slide bar frame 518. With this arrangement hydraulic cylinder 524 may serve to pivot the slide bar frame 518 mounted atop pivotable platform 531, which in turn is pivoted to fixed frame member 529, while cylinder 520 may serve to reciprocally push plate 510 on the pivotable slide bar frame.

To the end of dock 501 distal the push plate is secured a guide rail 540. A pair of endless chains 542 are mounted in mesh with drive sprockets 543 within two docks channels 545 which parallel the guide rail 540. A cradle 548 is pivotably mounted to a pair of transverse bars 549 which extend between a pair of fixed frame members 550. Pivotable movement is provided by a cylinder 553 which here is shown orienting the cradle in its down position. Extension of the cylinder piston rod 555 causes cradle 548 to swing in an upward arc about the parallel bars 549. The cradle itself supports cylinder 596 that has its piston rod 597 secured to a product push off plate 564 held pendant from the cradle by a slide collar 566. With this arrangement of hydraulic cylinders push off plate 564 may be advanced horizontally through elevators 570, returned horizontally through the elevator and then lowered back to its starting position during each product stacking operation.

The elevators 570 themselves are seen to include two sets of angle iron shelves 571 mounted to endless chains 572 in mesh with a pair of upper and a pair of lower sprockets rotatably mounted inside of elevator housing 575. The angle irons shelves are driven by a cylinder 595 which reciprocates a base plate 556 to which a pair of push arms 558 are pivoted. Each push arm has a pair of fingers 559 positioned to straddle a lug 560 projecting from a drive wheel 561 overlaying the lower sprockets. A pair of fixed cams 569 are also mounted to base plate 556 to engage lugs 560 upon cylinder extension to continue the advancement of the drive wheels slightly beyond that imparted by arms 558 during each stroke of piston 595. A tension spring 561 biases the arms 558 apart towards the fixed cams. A limit valve 563 is disposed between the upper pair of sprockets 574 to sense a fully stacked elevator condition and thereby initiate insertion of the stacked products into accumulator chamber 580 by the action of push off plate 564 secured to cradle 548.

Above the product accumulator chamber 580 are mounted a pair of product hold down brushes 582. A push off plate 584 is mounted to a piston rod 586 of a hydraulic cylinder 587 mounted adjacent the right side of the accumulator chamber as viewed in the figure. This device provides means for inserting the accumulated stack of products into the case positioned at the open end of a funnel 590 disposed to the left side of the accumulator chamber.

VI. CASE SEALING STATION

Figure 9:
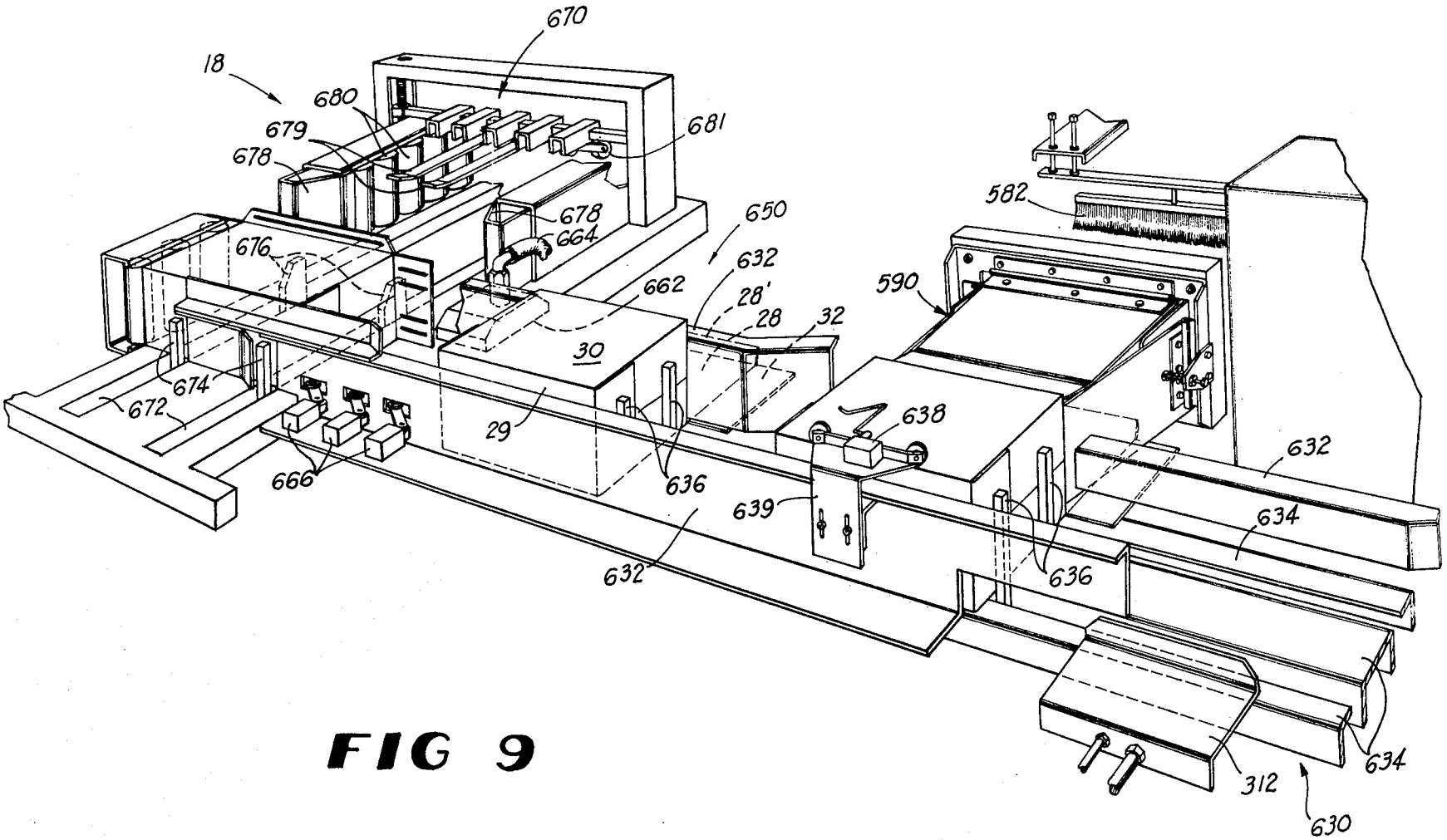
FIG. 9 is a perspective view of the case sealing station of the machine shown in FIG. 1.

With reference now to FIG. 9 the case sealing station is seen to include a walking beam conveyor 630 comprising a pair of rails 632 mounted astride a set of three mutually spaced channels irons 634. Three pairs of walking beams 636 are serially mounted to three unshown endless chains rotatably disposed beneath channels 634. A limit valve 638 is mounted to a bracket 639 in alignment with funnel 590 to sense the arrival of a case at the funnel mouth.

Down the walking beam conveyor 630 from funnel 590 is located a case stall position 650 and past this a hot melt glue head 662 to which glue is supplied via a conduit 664 which communicates with an unshown glue reservoir. This glue head is programmed to apply strips of glue to case end flaps 32 and top tab 28' by a sequential series of timer controls 666 mounted to a rail 632. Past the glue head is located a pair of case top folding cams 676 which are reciprocally raised and lowered by unshown hydraulic cylinder means mounted beneath the walking beams conveyor. Another walking beam 674 is provided for movement within a set of channels 672 in urging packed cases perpendicularly from the path of walking beam conveyor 630 into a case compression chamber 670. Two camming posts 678 are vertically positioned astride this chamber entrance for tucking back the case end flaps 32 while two roof cams 679 are located atop the chamber entrance to tuck back the case top tab. Finally, parallel sets of compression rollers 680 form the chamber sides while a bank of independently suspended spring urged rollers 681 are mounted atop the chamber exit.

VII. MACHINE OPERATION

The just described machine may be used in practicing the packaging process by energizing the hydraulic cylinders and controlling them through the limit valves. Products now introduced onto conveyor belt 20 will become spaced by belts 21 and 22 and then delivered onto the product receiving dock 501. Once a group of three packages of products are placed on the dock as shown in phantom lines in FIG. 7 limit switch 506 activates cylinder 520 which pushes the group over the surface of the dock into alignment with the entrance of elevator housing 575 beneath the leading edge of stop 540. When this is completed piston 524 pivots slide bar frame 578 which lifts push plate 510. With the push plate so raised cylinder 520 retracts the plate and then cylinder 524 pivots the slide bar frame back to its initial position bringing push plate 510 down to its initial position to complete a cycle of operation. That the push plate is raised above the dock during its return enables products to be received on the dock during this portion of the cycle thereby enhancing the speed of machine operations.

Once the group of products are set for entry into the elevator housing an unshown electric motor is energized driving chains 542 causing push bar 541 secured thereto to urge the group onto a pair of shelves provided by angle irons 571. Once each aligned pair of shelves is loaded, cylinder 555 raises that shelf readying the next successive pair of shelves for receipt of the next group of products. When five layers of products are so loaded as shown in phantom lines in FIG. 8, acutation limit valve 563 causes cylinder 560 to urge push plate 564 through the elevator housing thereby pushing the stacked products into accumulator chamber 580. During the return cycle cradle 548 pivots upwardly thereby raising push plate 564 to insure that it does not strike any products on dock 501 awaiting elevator entry. This action further enhances the speed of machine operations. Once the stacked products are held in the accumulator chamber and a case is sensed by limit valve 638 to be in position at the end of funnel 590, cylinder 587 is actuated causing push plate 584 to urge the stack of products out of the accumulator chamber, through the funnel, and into the case.

To provide an open case for product packing case blanks 25 are stripped one at a time from the stack disposed upon drive screws 116 within the case storage and stripping station. This is done by the stripper plate or blade and blank indexing manifold assembly reciprocally driven by cylinder 168. As each blank is stripped from the stack of blanks glue is applied to two end flaps 32 by glue head 194. Once positioned in the case forming station 12 the forming head is driven against the case bottom panel 29. As the blank is so driven towards case receiving chamber 270 hold down plates 248 on pivotal cam bar 240 fold the front and rear case panels while the L-shaped folding fingers 246 fold back the four end sides. During this operation both fingers 246 and plates 248 pivot as the cam bars to which they are mounted pivot. Continued movement of the forming head forces the case within the receiving chamber 270 where rollers 272 compresses the end flaps and the folded end sides for a period of time against the forming head sufficient to insure permanent adherence.

Following the just described assembly of a case blank into an open case configuration indexing arm 280 retrieves the case from receiving chamber 270 and swings it over onto the end of walking beam 630. In performing this operation the hinged roller compartment 274 swings open as previously described. Once positioned on the walking beam conveyor push off plate 312 releases the case from the indexing mechanism and walking beams 636 delivers it in front of funnel 590 where the stacked products are inserted. From here the packed case is stepped down the walking beam conveyor, through the case stall position, and then under glue head 662 which applies strips of glue to the open pair of end flaps and to the top tab. Folding cams 676 then fold up the case top panel and walking beams 674 moves the case into compression chamber 670 through caming posts 678 and roof cams 679 which bring the end flaps into abutment atop end sides 33 and tab 28' into abutment atop front panel 30. After a pause in the compression chamber of sufficient duration to allow the glue to bond, the packed case is exited from the machine.

I claim:

1. In a packaging machine having means for forming a flat case blank into an open case at a case forming station including a forming head mounted for movement along a linear path terminating between parallel sets of compression rollers and means for transferring the formed open cases from the case forming station to a product stacking and packing station the improvement comprising means for moving selected member rollers of one of said sets between a position relatively remote from and a position relatively close to said path and wherein said transferring means includes case gripping means and means for moving said case gripping means along a path passing closely adjacent said rollers remote position.

2. The packaging machine of claim 1 wherein said forming means includes a pair of spaced pivotable bars and said case forming head being movable along a path passing between said pivotable bars.

3. The packaging machine of claim 2 wherein said forming means further includes a set of case panel folding fingers rigidly secured to and projecting from each of said pivotable bars towards said path.

4. The packaging machine of claim 3 wherein portions of at least some of said folding fingers project from said bars closely along side said path.

5. The packaging machine of claim 2 wherein said forming means further includes a pair of compression rollers mounted astride said path for rotation about parallel axes.

6. The packaging machine of claim 1 wherein said case gripping means is mounted for reciprocal movement between a position adjacent said case forming station and a position adjacent said case stacking and packing station.

7. The packaging machine of claim 6 wherein said case gripping means includes a suction manifold having an aperture disposed between a pair of spring biased case gripping fingers.

8. The packaging machine of claim 6 wherein said transferring means includes an index arm to an end of which said case gripping means is secured, and hydraulic cylinder means for pivoting said index arm.

9. The packaging machine of claim 6 wherein said transferring means further includes a push plate mounted at said position adjacent said case stacking and packing station for reciprocal movement along a linear path.

* * * * *